US008787813B2

(12) United States Patent
Tano et al.

(10) Patent No.: US 8,787,813 B2
(45) Date of Patent: Jul. 22, 2014

(54) CLEANING BLADE, CLEANING DEVICE, PROCESS CARTRIDGE, AND IMAGE FORMING APPARATUS

(71) Applicant: Fuji Xerox Co., Ltd., Tokyo (JP)

(72) Inventors: Daisuke Tano, Kanagawa (JP); Masato Ono, Kanagawa (JP); Tsutomu Sugimoto, Kanagawa (JP); Noriaki Kojima, Kanagawa (JP); Kei Tanaka, Kanagawa (JP); Yoshinori Takahashi, Kanagawa (JP)

(73) Assignee: Fuji Xerox Co., Ltd, Tokyo (JP)

( * ) Notice: Subject to any disclaimer, the term of this patent is extended or adjusted under 35 U.S.C. 154(b) by 48 days.

(21) Appl. No.: 13/757,174

(22) Filed: Feb. 1, 2013

(65) Prior Publication Data

US 2014/0086653 A1 Mar. 27, 2014

(30) Foreign Application Priority Data

Sep. 25, 2012 (JP) ..... 2012-210550

(51) Int. Cl.
*G03G 21/00* (2006.01)
*G03G 21/18* (2006.01)

(52) U.S. Cl.
CPC ..... *G03G 21/0011* (2013.01); *G03G 21/1814* (2013.01)
USPC ..... 399/350

(58) Field of Classification Search
USPC ..... 399/350
See application file for complete search history.

(56) References Cited

U.S. PATENT DOCUMENTS

| | | | | |
|---|---|---|---|---|
| 2007/0031753 | A1* | 2/2007 | Abe et al. | 430/125 |
| 2008/0027184 | A1* | 1/2008 | Ueno et al. | 525/459 |
| 2014/0086655 | A1* | 3/2014 | Kojima et al. | 399/350 |
| 2014/0086656 | A1* | 3/2014 | Takahashi | 399/350 |

FOREIGN PATENT DOCUMENTS

| | | |
|---|---|---|
| JP | A 5-119676 | 5/1993 |
| JP | A 2010-134111 | 6/2010 |

* cited by examiner

*Primary Examiner* — G. M. Hyder
(74) *Attorney, Agent, or Firm* — Oliff PLC

(57) ABSTRACT

Provided is a cleaning blade having at least a portion that comes in contact with a member to be cleaned is configured of a member that contains polyurethane rubber, and that has an endothermic peak top temperature obtained by differential scanning calorimetry in a range of from 180° C. to 220° C.

20 Claims, 3 Drawing Sheets

CLEANING BLADE, CLEANING DEVICE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2012-210550 filed Sep. 25, 2012.

BACKGROUND

1. Technical Field

The present invention relates to a cleaning blade, a cleaning device, a process cartridge, and an image forming apparatus.

2. Related Art

In the related art, in a copying machine, a printer, a facsimile and the like of an electrophotographic method, a cleaning blade has been used as a cleaning unit for cleaning a remaining toner or the like of a surface of an image holding member such as a photoreceptor.

SUMMARY

According to an aspect of the invention, there is provided a cleaning blade including at least a portion that comes in contact with a member to be cleaned is configured of a member that contains polyurethane rubber, and that has an endothermic peak top temperature obtained by differential scanning calorimetry in a range of from 180° C. to 220° C.

BRIEF DESCRIPTION OF THE DRAWINGS

Exemplary embodiments of the present invention will be described in detail based on the following figures, wherein.

DETAILED DESCRIPTION

Figure 1:
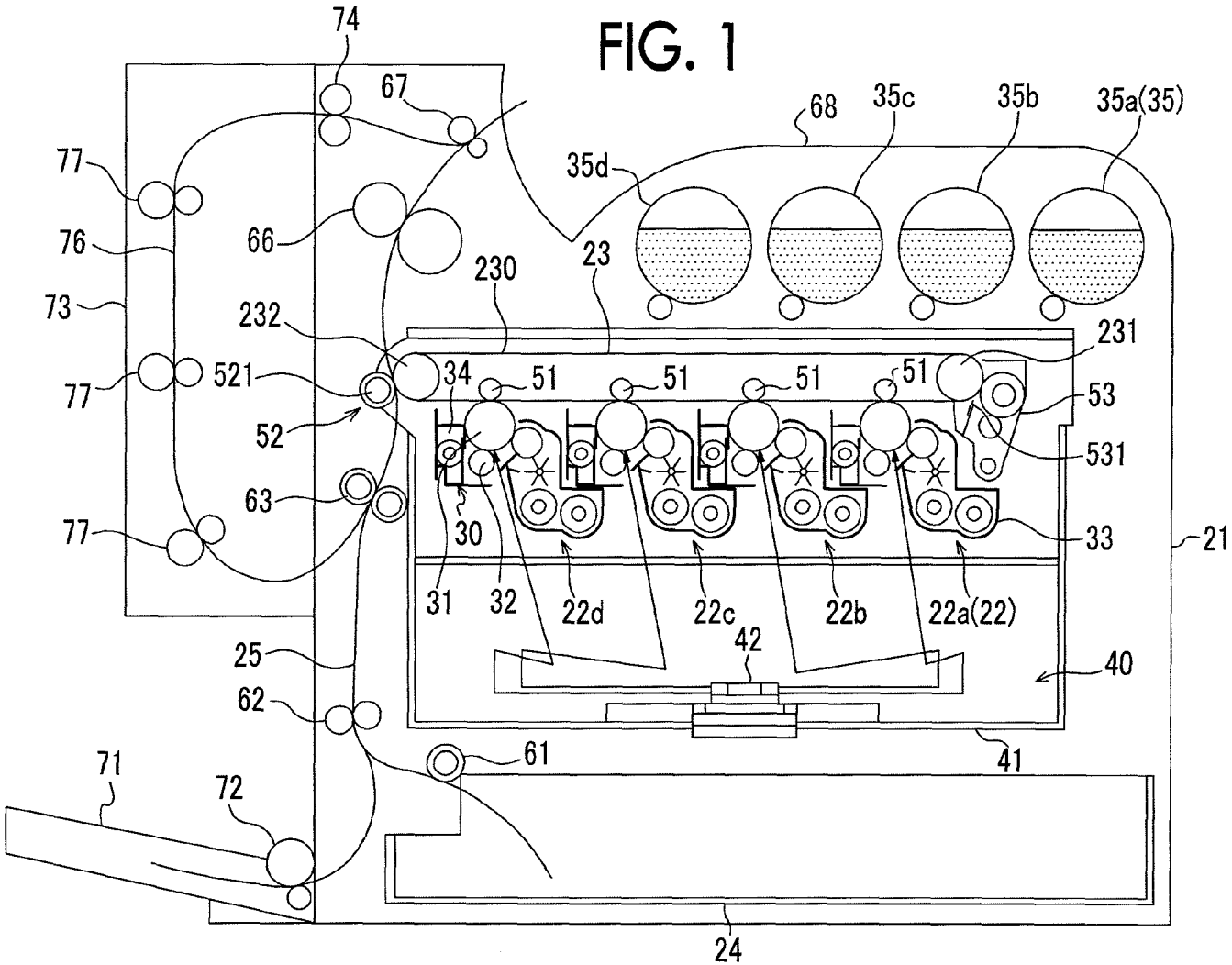
FIG. 1 is a schematic view showing an example of an image forming apparatus according to an exemplary embodiment.

Hereinafter, exemplary embodiments of a cleaning blade, a cleaning device, a process cartridge, and an image forming apparatus of exemplary embodiments of the invention will be described in detail.

Cleaning Blade

In the cleaning blade according to the exemplary embodiment, at least a portion that comes in contact with a member to be cleaned is configured of a member that contains polyurethane rubber, and that has an endothermic peak top temperature obtained by differential scanning calorimetry in a range of from 180° C. to 220° C.

Since the cleaning blade used for the image forming apparatus or the like slides while coming in contact with the member to be cleaned (image holding member or the like), a contacting portion is gradually abraded and the life thereof changes due to the extent of the abrasion. Accordingly, an abrasion resistance property is necessary from a view point of a long lifetime. However, a required property of the rubber is not obtained when applying the abrasion resistance property to the cleaning blade, and as a result, a crack may occur on the contacting portion of the blade and the member to be cleaned (image holding member or the like) from repeated use. That is, it is difficult to satisfy both the abrasion resistance property and the suppression of the crack.

On the other hand, in the cleaning blade according to the exemplary embodiment, the member of polyurethane rubber which has an endothermic peak top temperature (that is, melting temperature) obtained by differential scanning calorimetry in a range of from 180° C. to 220° C. is provided at least on the contacting portion with the member to be cleaned, and as a result, both the excellent abrasion resistance property and the suppression of the crack are satisfied.

The polyurethane member with high endothermic peak top temperature (melting temperature) of equal to or higher than 180° C. is obtained by improving the crystalline property of polyurethane, and the cleaning blade according to the exemplary embodiment is assumed to have an excellent abrasion resistance property by improving the crystalline property.

If the endothermic peak top temperature (melting temperature) is lower than 180° C. and the crystalline property is low, the abrasion resistance property is degraded. Meanwhile, if the endothermic peak top temperature (melting temperature) exceeds 220° C. and the crystalline property is extremely high, since the elasticity of the rubber is not obtained, the permanent elongation is degraded and the crack occurs due to the sliding with the member to be cleaned.

The cleaning blade according to the exemplary embodiment satisfies both the excellent abrasion resistance property and the suppression of the crack by improving and controlling the crystalline property in an appropriate range, that is, by setting the endothermic peak top temperature (melting temperature) in an appropriate range.

In addition, in the related art, from a view point of reducing friction of the contacting portion of the cleaning blade, a lubricant such as zinc stearate has been applied to the contacting portion. However, in the cleaning blade according to the exemplary embodiment, since the use of the lubricant is reduced or the cleaning is performed without using the lubricant, contamination or the like due to adhesion of the lubricant may be suppressed.

Endothermic Peak Top Temperature

The cleaning blade according to the exemplary embodiment has an endothermic peak top temperature (melting temperature) obtained by differential scanning calorimetry (DSC) of from 180° C. to 220° C. Further, it is preferable that the endothermic peak top temperature is from 185° C. to 215° C. It is even more preferable that the endothermic peak top temperature is from 190° C. to 210° C.

In addition, the endothermic peak top temperature (melting temperature) is measured by the differential scanning calorimetry (DSC) according to ASTM D3418-99. PerkinElmer's Diamond-DSC is used for the calorimetry, a melting temperature of indium and zinc is used for the temperature correction of a device detection unit, and heat of fusion of indium is used for the correction of calorie. An aluminum pan is used for a calorimetry sample, and an empty pan is set for comparison and the calorimetry is performed.

As a unit which controls the endothermic peak top temperature (melting temperature) in the range, a method of improving and controlling the crystalline property of the polyurethane member in an appropriate range is used. It is not particularly limited thereto, however, a method of further growing a hard segment aggregate of the polyurethane is used for further improving the crystalline property, and in more detail, a method of adjusting is used so that physical crosslink (cross-link with hydrogen bonding between hard segments) more efficiently proceeds than chemical crosslink (cross-link with crosslinking agent), when forming a cross-linked structure of the polyurethane. In addition, in a case of polymerization of the polyurethane, as a polymerization temperature is set to be low, aging time becomes long, and as a result, the physical crosslink tends to be proceeded more.

The method of controlling described above will be described later in detail.

Particle Size and Particle Size Distribution (Standard Deviation σ) of Hard Segment Aggregate In addition, in the exemplary embodiment, it is preferable that the polyurethane rubber includes a hard segment and a soft segment, and an average particle size of an aggregate of the hard segment is from 4 μm to 20 μm.

By setting the average particle size of the aggregate of the hard segment to be equal to or more than 4 μm, a crystalline area in the blade surface may be increased and a sliding property may be improved. Meanwhile, by setting the average particle size of the aggregate of the hard segment to be equal to or less than 20 μm, a low-friction property may be maintained without losing toughness (crack resistance).

The average particle size is more preferably from 5 μm to 15 μm, and further preferably from 5 μm to 10 μm.

In addition, it is preferable that the particle size distribution (standard deviation σ) of the aggregate of the hard segment is equal to or more than 2 μm.

The particle size distribution (standard deviation σ) of the aggregate of the hard segment being equal to or more than 2 (m shows that various particle sizes are mixed, and an effect of high hardness due to the increase of the contacting area with the soft segment materials, is obtained with small aggregates, and an effect of the improvement of sliding property is obtained with large aggregates.

The particle size distribution (standard deviation σ) is more preferably 2 μm to 5 μm, and further preferably 2 μm to 3 μm.

In addition, the average particle size and the particle size distribution (standard deviation σ) of the hard segment aggregate are measured with the following method. An image is captured with a magnification of 20× by using a polarization microscope (BX51-P manufactured by Olympus), the image is binarized by being subject to an imaging process, the particle size thereof is measured with 20 cleaning blades by measuring five points for one cleaning blade (measuring five aggregates for one point), and the average particle size from 500 particle sizes is calculated.

In addition, with the image binarization, threshold values of hue, chroma, and illuminance are adjusted so as to display black for crystal portion and white for non-crystal portion by using image processing software of OLYMPUS Stream essentials (manufactured by Olympus).

In addition, the particle size distribution (standard deviation σ) is calculated from the measured 500 particle sizes with the following equation.

$$\text{Standard deviation } \sigma=\sqrt{\{(X1-M)^2+(X2-M)^2+\ldots+(X500-M)^2\}/500}$$

Xn: Measured particle size n (n=from 1 to 500)

M: Average value of the measured particle size

The particle size and the particle size distribution (standard deviation σ) of the hard segment aggregates are controlled in the range described above. It is not particularly limited to a unit thereof, and for example, methods of reaction control with a catalyst, three-dimensional network control with a crosslinking agent, crystal growth control with aging conditions, and the like are used.

Next, a configuration of the cleaning blade according to the exemplary embodiment will be described.

The cleaning blade of the exemplary embodiment may include a member (hereinafter, referred to as "specified member") which contains polyurethane rubber and which has an endothermic peak top temperature obtained by differential scanning calorimetry in a range of from 180° C. to 220° C. at least on a portion which comes in contact with a member to be cleaned. That is, the cleaning blade may have a two-layer configuration in which a first layer that is formed of the specified member and comes in contact with a surface of the member to be cleaned and a second layer on a back surface of the first layer as a back surface layer are provided, or may have a configuration with three layers or more. In addition, the cleaning blade may have a configuration in which only corners of the portion which comes in contact with the member to be cleaned is formed of the specified member, and the vicinity thereof is formed of other materials.

In addition, a typical cleaning blade is used by being attached to a rigid plate-like support.

Composition of Specified Member

The specified member of the cleaning blade according to the exemplary embodiment contains polyurethane rubber, and has an endothermic peak top temperature obtained by differential scanning calorimetry in a range of from 180° C. to 220° C.

The polyurethane rubber is synthesized by polymerizing typical polyisocyanate and polyol. In addition, other than polyol, a resin including a functional group which may react with an isocyanate group may be used. In addition, it is preferable that the polyurethane rubber includes a hard segment and a soft segment.

Herein, the "hard segment" and the "soft segment" mean segments which are configured of a material, in which a material configuring the former is relatively harder than a material configuring the latter, and in which a material configuring the latter is relatively softer than a material configuring the former, in the polyurethane rubber materials.

It is not particularly limited, however, as a combination of the material (hard segment material) configuring the hard segment and the material (soft segment material) configuring the soft segment, well-known resin materials may be selected so as to have a combination in which one is relatively harder than another, and the other one is relatively softer than the one. In this exemplary embodiment, the following combination is suitable.

Soft Segment Material

First, examples of polyol as the soft segment material include polyester polyol obtained by a dehydration synthesis of diol and dibasic acid, polycarbonate polyol obtained with a reaction of diol and alkyl carbonate, polycaprolactonepolyol, polyether polyol, or the like. In addition, as a commercialized product of the polyol used as the soft segment material, PLACCEL 205 or PLACCEL 240 manufactured by Daicel Corporation is used.

Hard Segment Material

In addition, as the hard segment material, it is preferable to use a resin including a functional group which may react with respect to an isocyanate group. Further, flexible resin is preferable, and a resin with aliphatic system including a straight-chain structure is more preferable from a viewpoint of flexibility. As a detailed example, it is preferable to use an acrylic resin including two or more hydroxyl groups, a polybutadiene resin including two or more hydroxyl groups, an epoxy resin including two or more epoxy groups, or the like.

As a commercialized product of the acrylic resin including two or more hydroxyl groups, for example, ACTFLOW (Grade: UMB-2005B, UMB-2005P, UMB-2005, UME-2005 or the like) manufactured by Soken Chemical & Engineering Co., Ltd is used.

As a commercialized product of the polybutadiene resin including two or more hydroxyl groups, for example, R-45HT or the like manufactured by Idemitsu Kosan Co., Ltd. is used.

As for the epoxy resin including two or more epoxy groups, a resin having a hard and fragile property as a general epoxy resin of the related art is not preferable, but a resin having a softer and stronger property than the epoxy resin of the related art is preferable. As the epoxy resin, for example, in a property of a molecular structure, in a main chain structure thereof, a resin including a structure (flexible skeleton) which may increase the mobility of the main chain is suitable, and as the flexible skeleton, an alkylene skeleton, cycloalkane skeleton, a polyoxyalkylene skeleton or the like is used, and particularly a polyoxyalkylene skeleton is suitable.

In addition, in a physical property, an epoxy resin in which viscosity is low compared with molecular weight is suitable compared with the epoxy resin of the related art. In detail, weight-average molecular weight is in a range of 900±100, viscosity in 25° C. is preferably in a range of 15000±5000 mPa·s and more preferably in a range of 15000±3000 mPa·s. As a commercialized product of the epoxy resin including the properties described above, EPLICON EXA-4850-150 or the like manufactured by DIC Corporation is used.

In a case of using the hard segment material and the soft segment material, a weight ratio (hereinafter, referred to as "hard segment material ratio") of the material configuring the hard segment with respect to the total of the hard segment material and the soft segment material is preferably in a range of from 10% by weight to 30% by weight, more preferably in a range of from 13% by weight to 23% by weight, and even more preferably in a range of from 15% by weight to 20% by weight.

Since the hard segment material ratio is equal to or greater than 10% by weight, the abrasion resistance property is obtained and an excellent cleaning property is maintained over a long period. Meanwhile, since the hard segment material ratio is equal to or less than 30% by weight, the flexibility and expendability is obtained while preventing becoming too hard, the generation of the crack is suppressed, and an excellent cleaning property is maintained over a long period.

Polyisocyanate

As polyisocyanate used for the synthesis of the polyurethane rubber, for example, 4,4'-diphenyl methane diisocyanate (MDI), 2,6-toluene diisocyanate (TDI), 1,6-hexane diisocyanate (HDI), 1,5-naphthalene diisocyanate (NDI), and 3,3-dimethylphenyl-4,4-diisocyanate (TODI) are used.

In addition, in a viewpoint of easy formation of the hard segment aggregate with the required size (particle size), as polyisocyanate, 4,4'-diphenyl methane diisocyanate (MDI), 1,5-naphthalene diisocyanate (NDI), and hexamethylene diisocyanate (HDI) are more preferable.

A blending quantity of polyisocyanate with respect to resins with 100 parts by weight including a functional group which may react with respect to the isocyanate group is preferably from 20 parts by weight to 40 parts by weight, more preferably from 20 parts by weight to 35 parts by weight, and even more preferably from 20 parts by weight to 30 parts by weight.

Since the blending quantity is equal to or more than 20 parts by weight, a large bonding amount of urethane is secured to obtain the hard segment growth, and a required hardness is obtained. Meanwhile, since the blending quantity is equal to or less than 40 parts by weight, the hard segment does not become too large, the expandability is obtained, and the generation of the crack of the cleaning blade is suppressed.

Crosslinking Agent

As a crosslinking agent, diol (bifunction), triol (trifunction), tetraol (tetrafunction), or the like is used, and these may be used together. In addition, as a crosslinking agent, an amine based compound may be used. Further, a crosslinking agent with trifunction or more is preferable to be used for crosslinking. As the trifunctional crosslinking agent, for example, trimethylolpropane, glycerin, tri-isopropanolamine and the like are used.

A blending quantity of the crosslinking agent with respect to resins with 100 parts by weight including a functional group which may react with respect to the isocyanate group is preferably equal to or less than 2 parts by weight. Since the blending quantity is equal to or less than 2 parts by weight, molecular motion is not restrained due to chemical crosslink, hard segment derived from urethane bonding due to aging is largely grown, and the required hardness is easily obtained.

Method of Manufacturing Polyurethane Rubber

For manufacture of the polyurethane rubber member configuring the specified member of the exemplary embodiment, a general method of manufacturing the polyurethane such as a prepolymer method or a one-shot method is used. Since polyurethane with excellent intensity and abrasion resistance property is obtained, the prepolymer method is suitable for the exemplary embodiment, however the method of manufacturing is not limited.

In addition, as a unit that controls the endothermic peak top temperature (melting temperature) of the specified member within the range described above, a method of improving crystalline property of the polyurethane member and controlling the endothermic peak top temperature within a proper range is used, and for example, a method of further growing the hard segment aggregate of the polyurethane is used. In detail, a method of adjusting so that physical crosslink (crosslink with hydrogen bonding between hard segments) proceeds efficiently compared to the chemical crosslink (crosslink with the crosslinking agent) in a case of the formation of the cross-linked structure of the polyurethane is used, and in a case of polymerization of the polyurethane, as a polymerization temperature is set to be low, aging time becomes long, and as a result, the physical crosslink tends to proceed more.

Such polyurethane rubber member is molded by blending the isocyanate compound and the crosslinking agent or the like to the polyol described above under molding conditions to suppress unevenness of molecular arrangement.

In detail, in a case of adjusting a polyurethane composition, the polyurethane composition is adjusted by setting a temperature of polyol or prepolymer low or setting a temperature of curing and molding low so the crosslink proceeds slowly. Since the urethane bonding portion is aggregated and a crystalline member of the hard segment is obtained by setting the temperatures (temperature of polyol or prepolymer and temperature of curing and molding) low to lower a reactive property, the temperatures are adjusted so that the particle size of the hard segment aggregate becomes the required crystal size.

Accordingly, a state in which the molecule included in the polyurethane composition is arranged is set, and in a case of measuring the DSC, the polyurethane rubber member including the crystalline member in which the endothermic peak top temperature of crystal melting energy is in the range described above is molded.

In addition, the amounts of the polyol, the polyisocyanate, and the crosslinking agents, ratio of crosslinking agents, and the like are adjusted within a required range.

In addition, the molded product of the cleaning blade is manufactured by forming the composition for cleaning formation prepared by the method described above in a sheet shape and performing a cut process and the like, using centrifugal molding or extrusion molding.

Herein, as an example, a method of manufacturing the cleaning blade will be described in detail.

First, the soft segment material (for example, polycaprolactone polyol) and the hard segment material (for example, acrylic resin including two or more hydroxyl groups) are mixed (for example, a weight ratio of 8:2).

Next, the isocyanate compound (for example, 4,4'-diphenyl methane diisocyanate) is added with respect to the mixture of the soft segment material and the hard segment material, and reacts under a nitrogen atmosphere for example. At that time, the temperature is preferably 60° C. to 150° C., and more preferably 80° C. to 130° C. In addition, the reaction time is preferably 0.1 hour to 3 hours, and more preferably 1 hour to 2 hours.

Next, the isocyanate compound is further added to the mixture, and the mixture is reacted under a nitrogen atmosphere for example, to obtain a prepolymer. At that time, the temperature is preferably 40° C. to 100° C., and more preferably 60° C. to 90° C. In addition, the reaction time is preferably 30 minutes to 6 hours, and more preferably 1 hour to 4 hours.

Next, the temperature of the prepolymer is increased and subjected to defoaming under the reduced pressure. At that time, the temperature is preferably 60° C. to 120° C., and more preferably 80° C. to 100° C. In addition, the reaction time is preferably 10 minutes to 2 hours, and more preferably 30 minutes to 1 hour.

After that, a crosslinking agent (for example, 1,4-butanediol or trimethylolpropane) is added and mixed with respect to the prepolymer, and a composition for the cleaning blade formation is prepared.

Next, the composition for the cleaning blade formation is poured into a mold of a centrifugal molding machine, and subjected to the curing reaction. At that time, the mold temperature is preferably 80° C. to 160° C., and more preferably 100° C. to 140° C. In addition, the reaction time is preferably 20 minutes to 3 hours, and more preferably 30 minutes to 2 hours.

Further, the composition is subjected to crosslinking reaction, cooled, and cut, and the cleaning blade is formed. The temperature of aging heating in a case of crosslinking reaction is preferably 70° C. to 130° C., and more preferably 80° C. to 130° C., and further more preferably 100° C. to 120° C. In addition, the reaction time is preferably 1 hour to 48 hours, and more preferably 10 hours to 24 hours.

Physical Property

In the specified member, a ratio of the physical crosslink (cross-link with hydrogen bonding between hard segments) to the chemical crosslink (crosslink with crosslinking agent) "1" in the polyurethane rubber is preferably 1:0.8 to 1:2.0, and more preferably 1:1 to 1:1.8.

Since the ratio of the physical crosslink to the chemical crosslink is equal to or greater than the lower limit, the hard segment aggregate further grows and an effect of the low friction property derived from the crystal is obtained. Meanwhile, since the ratio of the physical crosslink to the chemical crosslink is equal to or lower than the upper limit, an effect of maintaining the toughness is obtained.

In addition, the ratio of the chemical crosslink and the physical crosslink is calculated using the following Mooney-Rivlin equation.

$$S=2C_1(\lambda-1/\lambda^2)+2C_2(1-1/\lambda^3)$$

S: stress, X: strain, $C_1$: chemical crosslink density, $C_2$: physical crosslink density In addition, S and λ at the time of extension of 10% are used with a stress-strain curve by a tension test.

In the specified member, a ratio of the hard segment to the soft segment "1" in the polyurethane rubber is preferably 1:0.15 to 1:0.3, and more preferably 1:0.2 to 1:0.25.

Since the ratio of the hard segment to the soft segment is equal to or greater than the lower limit, an amount of hard segment aggregates increases and thus an effect of the low-friction property is obtained. Meanwhile, since the ratio of the hard segment to the soft segment is equal to or lower than the upper limit, an effect of maintaining the toughness is obtained.

In addition, with the ratio of the soft segment and the hard segment, a composition ratio is calculated from a spectrum area of isocyanate as the hard segment component, a chain extender, and polyol as the soft segment component, using $^1$H-NMR.

The weight-average molecular weight of the polyurethane rubber member of the exemplary embodiment is preferably in a range of from 1000 to 4000, and more preferably in a range of from 1500 to 3500.

Back Surface Layer in Two-Layer Configuration

The cleaning blade of the exemplary embodiment may have a plural-layer configuration in which a first layer which brings the specified member in contact with the member to be cleaned is set and a back surface layer is further provided on the back surface of the first layer.

As a material used for the back surface layer, for example, a polyurethane rubber, a silicon rubber, a fluorine rubber, a chloroprene rubber, a butadiene rubber or the like is used. Among them, the polyurethane rubber is preferable. As the polyurethane rubber, ester based polyurethane and ether based polyurethane are used, and ester based polyurethane is particularly preferable.

In addition, in a case of manufacturing the polyurethane rubber, there is a method using polyol and polyisocyanate.

As polyol, polytetramethylether glycol, polyethylene adipate, polycaprolactone or the like is used.

As polyisocyanate, 2,6-toluene diisocyanate (TDI), 4,4'-diphenyl methane diisocyanate (MDI), paraphenylene diisocyanate (PPDI), 1,5-naphthalene diisocyanate (NDI), 3,3-dimethyldiphenyl-4,4-diisocyanate (TODI) or the like is used. Among them, MDI is preferable.

In addition, as a curing agent for curing polyurethane, a curing agent such as 1,4-butanediol or trimethylolpropane, ethylene glycol, or a mixture thereof is used.

To describe the exemplary embodiment with a detailed example, it is preferable that 1,4-butanediol and trimethylolpropane as curing agents be used with prepolymer generated by mixing and reacting diphenyl methane-4,4-diisocyanate with respect to polytetramethylether glycol which was subjected to a dewatering process. In addition, an additive such as a reaction conditioning agent may be added thereto.

As a method of manufacturing a member for the back surface layer, a well-known method of the related at is used according to raw materials used for the manufacturing, and for example, the member is prepared by forming sheets and performing a cut process in a predetermined shape, using the centrifugal molding, the extrusion molding, or the like.

In addition, in a case of the multiple-layer configuration, the cleaning blade is manufactured by sticking the first layer and the back surface layer (in a case of a layer configuration with three layers or more, plural back surface layer) obtained with the method described above, together. As the sticking method, a double-faced tape, various adhesive agents or the like is suitably used.

In addition, the cleaning blade of the exemplary embodiment may be obtained by pouring materials of each layer with time difference when molding and bonding each material without providing adhesive layers.

Purpose

When cleaning the member to be cleaned using the cleaning blade of the exemplary embodiment, as the member to be cleaned which is the target for cleaning, it is not particularly limited as long as it is a member of which a surface is necessary to be cleaned in the image forming apparatus. For example, an intermediate transfer member, a charging roller, a transfer roller, a transporting belt for material to be transferred, paper transporting roller, an image holding member, a cleaning brush for removing toner, a detoning roller for removing toner, and the like are exemplified, however, in the exemplary embodiment, the image holding member is particularly preferable.

Cleaning Device, Process Cartridge, and Image Forming Apparatus

Next, a cleaning device, a process cartridge, and an image forming apparatus using the cleaning blade of the exemplary embodiment will be described.

The cleaning device of the exemplary embodiment is not particularly limited as long as it includes the cleaning blade of the exemplary embodiment as a cleaning blade which comes in contact with a surface of a member to be cleaned and cleans the surface of the member to be cleaned. For example, as a configuration example of the cleaning device, a configuration, in which the cleaning blade is fixed so that an edge tip faces an opening portion side in a cleaning case including an opening portion on a side of the member to be cleaned and a transporting member which guides foreign materials such as waste toner collected from the surface of the member to be cleaned by the cleaning blade to a foreign material collecting container is included, is used. In addition, two or more cleaning blades of the exemplary embodiment may be used in the cleaning device of the exemplary embodiment.

In a case of using the cleaning blade of the exemplary embodiment to clean the image holding member, in order to suppress an image deletion when forming an image, a force NF (Normal Force) to press the cleaning blade against the image holding member is preferably in a range of from 1.3 gf/mm to 2.3 gf/mm, and more preferably in a range of from 1.6 gf/mm to 2.0 gf/mm.

In addition, a length of a tip portion of the cleaning blade held in the image holding member is preferably in a range of from 0.8 mm to 1.2 mm, and more preferably in a range of from 0.9 mm to 1.1 mm.

An angle W/A (Working Angle) of the contacting portion of the cleaning blade and the image holding member is preferably in a range of from 8° to 14°, and more preferably in a range of from 10° to 12°.

Meanwhile, the process cartridge of the exemplary embodiment is not particularly limited as long as it includes the cleaning device of the exemplary embodiment as the cleaning device which comes in contact with surfaces of one or more members to be cleaned such as the image holding member, the intermediate transfer member, and the like and cleans the surfaces of the members to be cleaned, and for example, a process cartridge, that includes the image holding member and the cleaning device of the exemplary embodiment which cleans the surface of the image holding member and that is detachable from the image forming apparatus, is exemplified. For example, when it is a so-called tandem machine including the image holding member corresponding to toner of each color, the cleaning device of the exemplary embodiment may be provided for each image holding member. In addition, other than the cleaning device of the exemplary embodiment, a cleaning brush or the like may be used together.

Detailed Examples of Cleaning Blade, Image Forming Apparatus, and Cleaning Device Next, detailed examples of the cleaning blade and image forming apparatus and the cleaning device using the cleaning blade of the exemplary embodiment will be described in more detail with reference to the drawing.

FIG. 1 is a schematic view showing an example of the image forming apparatus according to the exemplary embodiment, and shows a so-called tandem type image forming apparatus.

In FIG. 1, reference numeral 21 denotes a main member housing, reference numerals 22 and 22*a* to 22*d* denote image forming engines, reference numeral 23 denotes a belt module, reference numeral 24 denotes a recording medium supply cassette, reference numeral 25 denotes a recording medium transporting path, reference numeral 30 denotes each photoreceptor unit, reference numeral 31 denotes a photoreceptor drum, reference numeral 33 denotes each developing unit, reference numeral 34 denotes a cleaning device, reference numerals 35 and 35*a* to 35*d* denote toner cartridges, reference numeral 40 denotes an exposing unit, reference numeral 41 denotes a unit case, reference numeral 42 denotes a polygon mirror, reference numeral 51 denotes a primary transfer unit, reference numeral 52 denotes a secondary transfer unit, reference numeral 53 denotes a belt cleaning device, reference numeral 61 denotes a sending-out roller and reference numeral 62 denotes a transporting roller, reference numeral 63 denotes a positioning roller, reference numeral 66 denotes a fixing device, reference numeral 67 denotes a discharge roller, reference numeral 68 denotes a discharge unit, reference numeral 71 denotes a manual feeder, reference numeral 72 denotes a sending-out roller, reference numeral 73 denotes a double side recording unit, reference numeral 74 denotes a guide roller, reference numeral 76 denotes a transporting path, reference numeral 77 denotes a transporting roller, reference numeral 230 denotes an intermediate transfer belt, reference numerals 231 and 232 denote support rollers, reference numeral 521 denotes a secondary transfer roller, and reference numeral 531 denotes a cleaning blade.

In the tandem type image forming apparatus shown in FIG. 1, the image forming engines 22 (in detail, 22*a* to 22*d*) with four colors (in the exemplary embodiment, black, yellow, magenta, and cyan) are arranged in the main member housing 21, and on the upper portion thereof, the belt module 23 in which the intermediate transfer belt 230 which circulation-transports along the arrangement direction of each image forming engine 22 is included, is disposed. Meanwhile, the recording medium supply cassette 24, in which a recording medium (not shown), such as paper, is accommodated is disposed on the lower portion of the main member housing 21, and the recording medium transporting path 25, which is a transporting path of the recording medium from the recording medium supply cassette 24, is disposed in a vertical direction.

In the exemplary embodiment, each image forming engine 22 (22*a* to 22*d*) forms toner images for black, yellow, magenta, and cyan (arrangement is not particularly limited to this order), in order from upstream in a circulation direction of the intermediate transfer belt 230, and includes each photoreceptor unit 30, each developing unit 33, and one common exposing unit 40.

Herein, each photoreceptor unit 30 includes the photoreceptor drum 31, a charging device (charging roller) 32 which charges the photoreceptor drum 31 in advance, and the cleaning device 34 which removes remaining toner on the photoreceptor drum 31 integrally as sub-cartridges, for example.

In addition, the developing units 33 develop an electrostatic latent image formed by exposing in the exposing unit 40 on the charged photoreceptor drum 31 with the corresponding colored toner (in the exemplary embodiment, for example, negative polarity), and configure the process cartridge (so-called customer replaceable unit) by being integrating with the sub-cartridge formed of the photoreceptor unit 30, for example.

Further, the photoreceptor unit 30 may be separated from the developing unit 33 and used as the process cartridge alone. In addition, in FIG. 1, reference numerals 35 (35*a* to 35*d*) are toner cartridges (toner supplying path is not shown) for supplying each color component toner to each developing unit 33.

Meanwhile, the exposing unit 40 is disposed to accommodate, for example, four semiconductor lasers (not shown), one polygon mirror 42, an imaging lens (not shown), and each mirror (not shown) corresponding to each photoreceptor unit 30 in the unit case 41, to scan light from the semiconductor laser for each color component with deflection by the polygon mirror 42, and to guide an optical image to an exposing point on the corresponding photoreceptor drum 31 through the imaging lens and mirrors.

In addition, in the exemplary embodiment, the belt module 23 includes the intermediate transfer belt 230 to bridge between a pair of support rollers (one roller is a driving roller) 231 and 232, and each primary transfer unit (in this example, primary transfer roller) 51 is disposed on the back surface of the intermediate transfer belt 230 corresponding to the photoreceptor drum 31 of each photoreceptor unit 30. Since a voltage having reverse polarity with charging polarity of toner is applied to the primary transfer unit 51, the toner image on the photoreceptor drum 31 electrostatically transfers to the intermediate transfer belt 230 side. Further, the secondary transfer unit 52 is disposed on a portion corresponding to the support roller 232 on the downstream of the image forming engine 22*d* which is on the most downstream of the intermediate transfer belt 230, and performs second transfer (collective transfer) of the first transfer image on the intermediate transfer belt 230 to a recording medium.

In the exemplary embodiment, the secondary transfer unit 52 includes the secondary transfer roller 521 which is disposed to be pressure-welded on the toner image carrying surface side of the intermediate transfer belt 230, and aback surface roller (in this example, also used as the support roller 232) which is disposed on the rear surface side of the intermediate transfer belt 230 to be formed as an opposite electrode of the secondary transfer roller 521. In addition, for example, the secondary transfer roller 521 is grounded, and bias having the same polarity with the charging polarity of the toner is applied to the back surface roller (support roller 232).

In addition, the belt cleaning device 53 is disposed on the upstream of the image forming engine 22*a* which is on the most upstream of the intermediate transfer belt 230, and removes the remaining toner on the intermediate transfer belt 230.

In addition, the sending-out roller 61 which picks up a recording medium is disposed on the recording medium supply cassette 24, the transporting roller 62 which sends out the recording medium is disposed right behind the send-out roller 61, and a registration roller (positioning roller) 63 which supplies the recording medium to the secondary transfer portion at a predetermined timing is disposed on the recording medium transporting path 25 which positions in front of the secondary transfer portion. Meanwhile, the fixing device 66 is disposed on the recording medium transporting path 25 which is positioned on the downstream of the secondary transfer portion, the discharge roller 67 for discharge of the recording medium is disposed on downstream of the fixing device 66, and the discharged recording medium is accommodated in the discharge unit 68 formed on the upper portion of the main member housing 21.

In addition, in the exemplary embodiment, the manual feeder (MSI) 71 is disposed on the side of the main member housing 21, and the recording medium on the manual feeder 71 is sent towards the recording medium transporting path 25 through the sending-out roller 72 and the transporting roller 62.

In addition, the double side recording unit 73 is supplemented in the main member housing 21. And when a double side mode which performs image recording on double sides of a recording medium is selected, the double side recording unit 73 reverses a recording medium with the single side recorded. And the discharge roller 67 brings the recording medium to the inner portion through the guide roller 74 in front of an inlet, brings back the recording medium in the inner portion through the transporting rollers 77, transports the recording medium along the transporting path 76, and supplies the recording medium to the positioning roller 63 side again.

Next, the cleaning device 34 which is disposed in the tandem type image forming apparatus shown in FIG. 1 will be described in detail.

Figure 2:
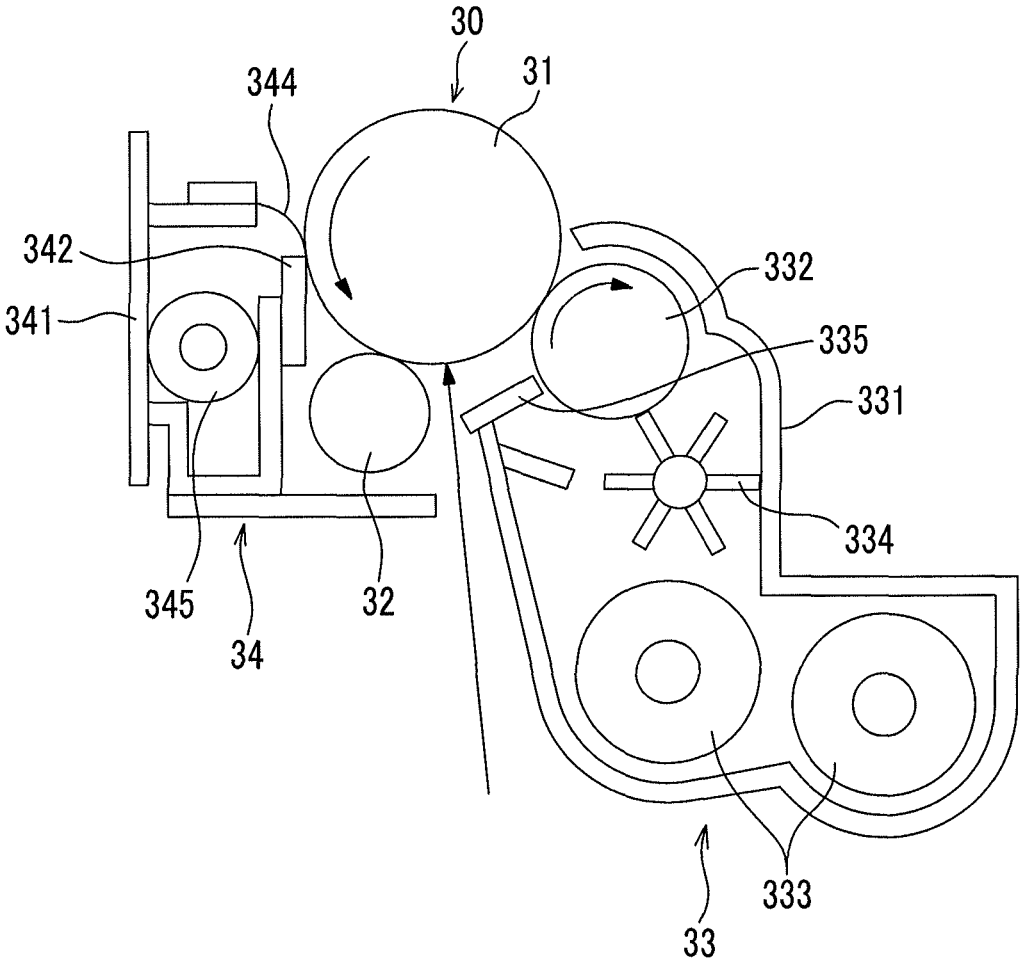
FIG. 2 is a schematic cross-sectional view showing an example of a cleaning device according to the exemplary embodiment.

FIG. 2 is a schematic cross-sectional view showing an example of the cleaning device of the exemplary embodiment, and is a view showing the cleaning device 34, the photoreceptor drum 31 and the charging roller 32 as the sub-cartridge, and the developing unit 33 shown in FIG. 1.

In FIG. 2, reference numeral 32 denotes the charging roller (charging device), reference numeral 331 denotes a unit case, reference numeral 332 denotes a developing roller, reference numerals 333 denote toner transporting members, reference numeral 334 denotes a transporting paddle, reference numeral 335 denotes a trimming member, reference numeral 341 denotes a cleaning case, reference numeral 342 denotes a cleaning blade, reference numeral 344 denotes a film seal, and reference numeral 345 denotes a transporting member.

The cleaning device 34 includes the cleaning case 341 which accommodates the remaining toner and which is open facing the photoreceptor drum 31, and in the cleaning device 34, the cleaning blade 342 which is disposed to come in contact with the photoreceptor drum 31 is attached to the lower edge of the opening of the cleaning case 341 through a bracket (not shown). Meanwhile, the film seal 344 which is held air-tightly with respect to the photoreceptor drum 31 is attached to the upper edge of the opening of the cleaning case 341. In addition, reference numeral 345 denotes a transporting member which guides waste toner accommodated in the cleaning case 341 to a waste toner container on the side.

Next, the cleaning blade provided on the cleaning device 34 will be described in detail with reference to the drawing.

Figure 3:
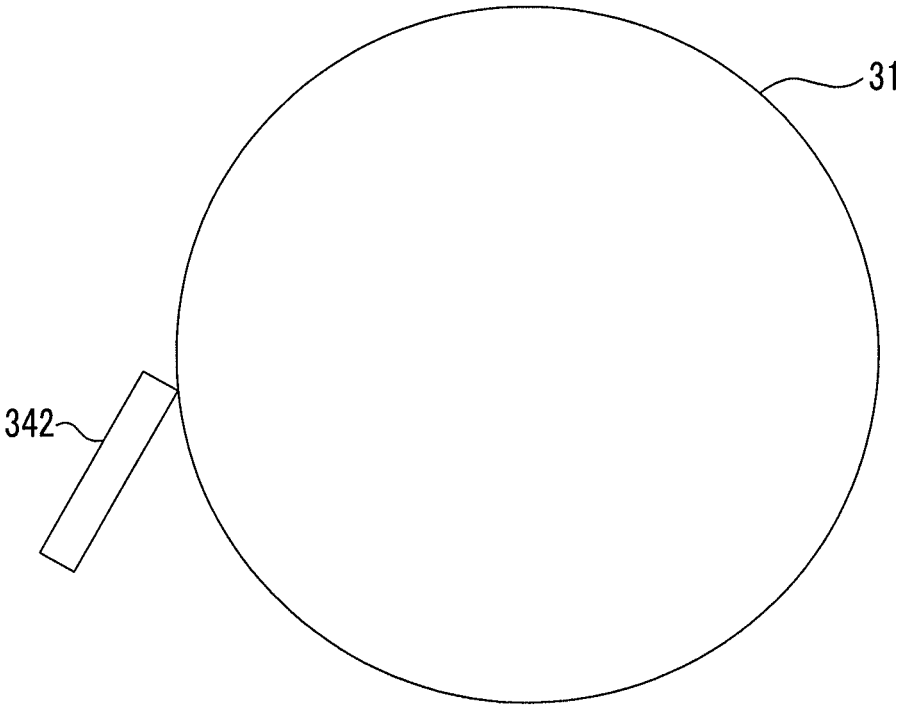
FIG. 3 is a schematic cross-sectional view showing an example of a cleaning blade according to the exemplary embodiment.

FIG. 3 is a schematic cross-sectional view showing an example of the cleaning blade of the exemplary embodiment, and is a view showing the cleaning blade 342 shown in FIG. 2 and the photoreceptor drum 31 which comes in contact thereto.

In addition, in the exemplary embodiment, in all cleaning devices 34 of respective image forming engines 22 (22*a* to 22*d*), the cleaning blade of the exemplary embodiment is used as the cleaning blade 342, and the cleaning blade of the exemplary embodiment may be used for the cleaning blade 531 used in the belt cleaning device 53.

In addition, as shown in FIG. 2, for example, the developing unit (developing device) 33 used in the exemplary embodiment includes the unit case 331 which accommodates a developer and opens facing the photoreceptor drum 31. Herein, the developing roller 332 is disposed on the portion which faces the opening of the unit case 331, and toner transporting members 333 for stirring and transporting of the developer are disposed in the unit case 331. Moreover, the transporting paddle 334 may be disposed between the developing roller 332 and the toner transporting member 333.

When developing, after supplying the developer to the developing roller 332, the developer is transported to a developing area facing the photoreceptor drum 31 in a state where the layer thickness of the developer is regulated in the trimming member 335, for example.

In the exemplary embodiment, as the developing unit 33, a two-component developer formed of toner and a carrier for example, is used, however, a single-component developer formed only of the toner may be used.

Next, an operation of the image forming apparatus according to the exemplary embodiment will be described. First, when respective image forming engines 22 (22*a* to 22*d*) form single-colored toner images corresponding to each color, the single-colored toner images of each color are sequentially superimposed so as to match with original document information and subjected to primary transfer to the surface of the intermediate transfer belt 230. Next, the colored toner images transferred to the surface of the intermediate transfer belt 230 is transferred to the surface of the recording medium in the secondary transfer unit 52, and the recording medium to which the colored toner image is transferred is subjected to a fixing process by the fixing device 66, and then, is discharged to the discharge unit 68.

Meanwhile, in the respective image forming engines 22 (22*a* to 22*d*), the remaining toner on the photoreceptor drum 31 is cleaned by the cleaning device 34, and the remaining toner on the intermediate transfer belt 230 is cleaned by the belt cleaning device 53.

In such image forming process, each remaining toner is cleaned by the cleaning device 34 (or belt cleaning device 53).

In addition, the cleaning blade 342 may be fixed through a spring material, other than being directly fixed with a frame member in the cleaning device 34 as shown in FIG. 2.

EXAMPLES

Hereinafter, Examples of the invention will be described in detail, however the invention is not limited only to the following Examples. In addition, in the description below, a "part" refers to a "part by weight".

Example 1

Cleaning Blade A1

First, polycaprolactone polyol (PLACCEL 205 manufactured by Daicel Corporation with an average molecular weight of 529 and a hydroxyl value of 212 KOHmg/g) and polycaprolactone polyol (PLACCEL 240 manufactured by Daicel Corporation with an average molecular weight of 4155 and a hydroxyl value of 27 KOHmg/g) are used as soft segment materials of polyol components. In addition, by using the acrylic resin including two or more hydroxyl groups (ACTFLOW UMB-2005B manufactured by Soken Chemical & Engineering Co., Ltd.) as a hard segment material, the soft segment materials and the hard segment material are mixed with a ratio of 8:2 (weight ratio).

Next, 6.26 parts of 4,4'-diphenyl methane diisocyanate (MILLIONATE MT manufactured by Nippon Polyurethane Industry Co., Ltd.) as the isocyanate compound is added to 100 parts of the mixture of the soft segment materials and the hard segment material, and the resultant mixture is reacted under a nitrogen atmosphere at 70° C. for three hours. In addition, the amount of the isocyanate compound used for this reaction is selected so that a ratio (isocyanate groups/hydroxyl groups) of the isocyanate groups with respect to the hydroxyl groups included in a reaction system becomes 0.5.

Next, 34.3 parts of the isocyanate compound is further added thereto, and the resultant mixture is reacted under a nitrogen atmosphere at 70° C. for three hours, and prepolymer is obtained. In addition, the entire amounts of the isocyanate compound used when using the prepolymer is 40.56 parts.

Next, the temperature of the prepolymer is increased to 100° C., and subjected to defoaming for one hour under the reduced pressure. After that, 7.14 parts of mixture (weight ratio=60/40) of 1,4-butanediol and trimethylolpropane is added to 100 parts of prepolymer and mixed for three minutes without foaming, and a composition A1 for cleaning blade formation is prepared.

Next, the composition A1 for cleaning blade formation is poured into the centrifugal molding machine in which a mold is adjusted to be at 140° C., and subjected to the curing reaction for one hour. Next, the composition A1 is aged and heated at 110° C. for 24 hours, cooled, and cut, and a cleaning blade A1 with a length of 8 mm and a thickness of 2 mm is obtained.

Example 2

A cleaning blade A2 is obtained with the method disclosed in Example 1, except that the temperature of the aging and heating used in Example 1 is changed to 75° C.

Example 3

A cleaning blade A3 is obtained with the method disclosed in Example 1, except that the temperature of the aging and heating used in Example 1 is changed to 85° C.

Example 4

A cleaning blade A4 is obtained with the method disclosed in Example 1, except that the temperature of the aging and heating used in Example 1 is changed to 100° C. and the weight ratio of the mixture of 1,4-butanediol and trimethylolpropane used in Example 1 is changed to 50/50.

Example 5

A cleaning blade A5 is obtained with the method disclosed in Example 1, except that the temperature of the aging and heating used in Example 1 is changed to 75° C., the heating and aging time used in Example 1 is changed to 32 hours, and the weight ratio of the mixture of 1,4-butanediol and trimethylolpropane used in Example 1 is changed to 65/35.

Example 6

A cleaning blade A6 is obtained with the method disclosed in Example 1, except that the temperature of the aging and heating used in Example 1 is changed to 70° C. and the weight ratio of the mixture of 1,4-butanediol and trimethylolpropane used in Example 1 is changed to 35/65.

Example 7

A cleaning blade A7 is obtained with the method disclosed in Example 1, except that the temperature of the aging and heating used in Example 1 is changed to 75° C. and the heating and aging time used in Example 1 is changed to 12 hours.

Comparative Example 1

A cleaning blade B1 is obtained with the method disclosed in Example 1, except that the temperature of the aging and heating used in Example 1 is changed to 150° C.

Comparative Example 2

A cleaning blade B2 is obtained with the method disclosed in Example 1, except that the temperature of the aging and heating used in Example 1 is changed to 115° C. and the weight ratio of the mixture of 1,4-butanediol and trimethylolpropane used in Example 1 is changed to 45/55.

Comparative Example 3

A cleaning blade B3 is obtained with the method disclosed in Example 1, except that the temperature of the aging and heating used in Example 1 is changed to 75° C., the heating and aging time used in Example 1 is changed to 32 hours, and the weight ratio of the mixture of 1,4-butanediol and trimethylolpropane used in Example 1 is changed to 70/30.

Comparative Example 4

A cleaning blade B4 is obtained with the method disclosed in Example 1, except that the soft segment materials used in Example 1 are changed to 1,9-ND adipate with a molecular weight of 2000 obtained from 1,9-nonanediol and adipic acid.

Measurement of Physical Property

The endothermic peak top temperature (melting temperature) of the cleaning blade obtained by differential scanning calorimetry is measured by the differential scanning calorimetry (DSC) according to ASTM D3418-99. PerkinElmer's Diamond-DSC is used for the calorimetry, a melting temperature of indium and zinc is used for a temperature correction of a device detection unit, and heat of fusion of indium is used for correction of calorie. An aluminum pan is used for a calorimetry sample, an empty pan is set for comparison, and the calorimetry is performed. A rate of temperature increase is 3° C./min and a measurement temperature range is 20° C. to 250° C. in a case of measuring with DSC at that time.

In addition, the average particle size and the particle size distribution (standard deviation σ) of aggregates of the hard segment of the cleaning blade are measured with the method described above.

In addition, a ratio of chemical crosslink (cross-link with crosslinking agent) and physical crosslink (cross-link with hydrogen bonding between hard segments) in the polyurethane rubber, and a ratio of the hard segment and the soft segment in the polyurethane rubber are measured with the method described above.

Further, a hardness (JIS-A) of the cleaning blade is measured with the following method.

The hardness (JIS-A) is a hardness measured using type A durometer disclosed in JISK6253 (1997), and measured by measuring three points of the photoreceptor contacting surface of the blade in an axis direction and obtaining an average value.

Image Quality Evaluation Test

Configuration of Image Forming Apparatus

The cleaning blades of the Examples and Comparative Examples obtained as described above are mounted as cleaning blades for photoreceptor drum of the image forming apparatus (product name: DocuCentre-II C7500 manufactured by Fuji Xerox Co., Ltd.) shown in FIG. 2, respectively.

Photoreceptor drum: organic photoreceptor (ϕ=30 mm)

Process rate: three rates of 220 mm/sec, 110 mm/sec, and 55 mm/sec

Charging device: charging roller of AC-superimposed DC

Developing device: two-component magnetic brush developing device

Cleaning blade: a length of 8 mm, a thickness of 2 mm, a free length of 7.0 mm, a contact angle of 25 degrees, and a pressing force NF of 2.0 gf/mm In the test, toner obtained by a polymerization method and having a shape factor in a range from 123 to 128, and an average particle size of 6 μm is used, and a two-component developer including the toner is accommodated in a developing machine of the image forming apparatus and used. Test printed (area ratio of 5% per single color) images of 50000 sheets by the image forming apparatus are used in conditions of a process rate of 220 mm/sec, high temperature and humidity of 28° C. and 85% RH, low temperature and humidity of 10° C. and 15% RH, and medium temperature and humidity of 22° C. and 55% RH, by repeatedly printing five sheets.

Evaluation of Blade Damage

After the test, generation of crack of the edge of the cleaning blade and burr of the cleaning blade itself is observed and evaluated with the following evaluation criteria.

A: Photoreceptor contacting surface is observed with a laser microscope and no crack is observed.

B: A tiny crack is generated, but no problem for the image.

C: A crack is generated and a problem in the image with vertical streaks is generated Evaluation of Blade Squeal In addition, the test is performed by changing the process rate to 110 mm/sec and 55 mm/sec, generation of squeal (abnormal noise) generated when rubbing of the photoreceptor and the cleaning blade is checked, and it is evaluated with the following evaluation criteria.

A: Only the driving sound of apparatus is generated.

B: Slight squeal of blade is generated in addition to the driving sound of the apparatus.

C: A lot of squeal of the blade is generated and anyone may recognize as strident.

Image Quality Evaluation

The cleaning blades of the Examples and Comparative Examples obtained as described above are mounted as cleaning blades for the photoreceptor drum of a color copying machine (DocuCentre Color a450 manufactured by Fuji Xerox Co., Ltd.).

The test is performed by repeating the image formation with an image concentration of 1% (solid image of 6.2 mm×1 mm is loaded on the A4-sized sheet) on the paper of 2000 sheets (C2r sheet manufactured by Fuji Xerox Co., Ltd.) by using the color copying machine. A deformation degree of the cleaning blade after that, and a generation state of image quality defects with color streaks are visually evaluated based on the following criteria.

A: Color streaks are not observed.

B: Minute color streaks are observed in an image, but in an acceptable range.

C: Color streaks are observed in an image, and not in the acceptable range.

Evaluation of Abrasion Resistance Property

The abrasion resistance property of the cleaning blade is evaluated with the following method.

abrasion depth and crack depth of the edge are deep and thus, the cleaning problem easily occurs in the test described above. The test is therefore useful for a qualitative evaluation of the abrasion or the crack of the edge tip.

Evaluation criteria of the abrasion of the edge are shown as follows. In addition, the acceptable ranges are A and B.

A: Abrasion depth of tip portion: 3 μm or less and no abrasion mark, cleaning problem: not generated B: Abrasion depth of tip portion: 5 μm or less, cleaning problem: not generated C: Abrasion depth of tip portion: more than 3 μm, cleaning problem: generated

TABLE 1

| | | Ex. 1 | Ex. 2 | Ex. 3 | Ex. 4 | Ex. 5 | Ex. 6 | Ex. 7 | Com. Ex. 1 | Com. Ex. 2 | Com. Ex. 3 | Com. Ex. 4 |
|---|---|---|---|---|---|---|---|---|---|---|---|---|
| Endothermic peak top temperature [° C.] | | 190 | 215 | 200 | 182 | 217 | 219 | 215 | 150 | 170 | 225 | 170 |
| Average particle size of hard segment aggregates [μm] | | 6 | 15 | 10 | 4 | 18 | 21 | 19 | Not measurable (small) | 3 | 25 | 6 |
| Particle size distribution (Standard Deviation σ) | | 2.8 | 23 | 1.5 | 5 | 25 | 5 | 30 | 2 | 1.8 | 5 | 1.5 |
| Ratio of chemical crosslink:physical cross link | | 1:1 | 1:1.6 | 1:1.2 | 1:0.8 | 1:1.9 | 1:2 | 1:1.8 | 1:0.6 | 1:0.7 | 1:2.3 | 1:0.8 |
| Ratio of soft segment:hard segment | | 1:0.18 | 1:0.26 | 1:0.22 | 1:0.16 | 1:0.28 | 1:0.3 | 1:0.27 | 1:0.12 | 1:0.14 | 1:0.32 | 1:0.15 |
| Hardness (JIS-A) | | 80 | 90 | 84 | 78 | 91 | 92 | 90 | 70 | 75 | 94 | 76 |
| Evaluation | Blade damage | A | B | B | A | A | B | A | C | C | C | C |
| | Blade squeal | A | A | A | A | A | A | A | C | C | A | C |
| | Abrasion resistance property | A | B | B | A | B | B | A | C | C | C | C |
| | Image quality | A | A | A | A | A | A | A | C | C | C | C |

An image is formed using A4-sized sheet (P paper of 210 mm×297 mm manufactured by Fuji Xerox Co., Ltd.) until the integrated number of revolutions of the photoreceptor becomes 100 K cycles, under an environment of high temperature and humidity (28° C., 85 RH %). After that, an abrasion depth of tip of a contacting portion (edge) of the cleaning blade and cleaning problem are evaluated together, and the edge abrasion is determined.

In addition, when performing the test, since the evaluation is performed under harsh conditions in which a lubricating effect of the contacting portion of the photoreceptor and the cleaning blade is reduced, the image density of an image to be formed is set as 1%.

In addition, the edge missing portion of the photoreceptor surface side which is checked when observed from the cross-sectional side of the cleaning blade using a laser microscope VK-8510 manufactured by Keyence Corporation, is employed as the maximum abrasion depth of the edge tip.

Further, after the completion of the test, in the evaluation of the cleaning problem, A3-sized sheet in which an untransferred solid image (solid image size of 1400 mm×290 mm) with image density of 100% is formed is fed between the photoreceptor and the cleaning blade in the normal process speed, the actual machine is stopped right after the last end portion of the unfixed image in the transporting direction passes the contacting portion of the photoreceptor and the cleaning blade, and the scrape of the toner is visually observed. If the scrap is significantly recognized, it is considered as a cleaning problem.

In addition, in a case where a portion for holding the toner is missing due to the abrasion and the crack of the edge tip, the As shown in Table 1 described above, in Example 1, since a high crystalline property with high endothermic peak top temperature (melting temperature) is obtained and particle size distribution (standard deviation σ) is large, a small crystalline portion may have high intensity with large bonding surface area with the soft segments and a large crystalline portion may include a sliding property, and thus, a cleaning blade with an excellent imaging performance is obtained.

In Example 2, it is considered that the blade squeal is reduced with the high crystalline property with the high endothermic peak top temperature (melting temperature). However, since it is assumed to be brittle compared to the case in Example 1, the blade damage is considered to be B which is a level with no problem in use.

Since the particle size distribution (standard deviation σ) in Example 3 is lower than the case in Example 1, the intensity and the sliding property are considered to be degraded compared to Example 1, but it is a level with no problem in use.

In Comparative Examples 1 and 2, a low crystalline property with low endothermic peak top temperature (melting temperature) is obtained, the particle size is small, the crack of edge and the blade squeal are generated, and thus an excellent image is not obtained.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An cleaning blade wherein at least a portion that comes in contact with a member to be cleaned is configured of a member that contains polyurethane rubber, and that has an endothermic peak top temperature obtained by differential scanning calorimetry in a range of from 180° C. to 220° C.

2. The cleaning blade according to claim 1, wherein the polyurethane rubber contains a hard segment and a soft segment.

3. The cleaning blade according to claim 2, wherein a ratio of the hard segment to the soft segment "1" in the polyurethane rubber is 1:0.15 to 1:0.3.

4. The cleaning blade according to claim 2, wherein an average particle size of aggregates of the hard segment is from 4 μm to 20 μm.

5. The cleaning blade according to claim 4, wherein particle size distribution (standard deviation σ) of the aggregates of the hard segment is equal to or more than 2 μm.

6. A cleaning device comprising the cleaning blade according to claim 1.

7. The cleaning device according to claim 6, wherein the polyurethane rubber contains a hard segment and a soft segment.

8. The cleaning device according to claim 7, wherein a ratio of the hard segment to the soft segment "1" in the polyurethane rubber is 1:0.15 to 1:0.3.

9. The cleaning device according to claim 7, wherein an average particle size of aggregates of the hard segment is from 4 μm to 20 μm.

10. The cleaning device according to claim 9, wherein particle size distribution (standard deviation σ) of the aggregates of the hard segment is equal to or more than 2 μm.

11. A process cartridge comprising:

the cleaning device according to claim 6, wherein the process cartridge is detachable from an image forming apparatus.

12. The process cartridge according to claim 11, wherein the polyurethane rubber contains a hard segment and a soft segment.

13. The process cartridge according to claim 12, wherein a ratio of the hard segment to the soft segment "1" in the polyurethane rubber is 1:0.15 to 1:0.3.

14. The process cartridge according to claim 12, wherein an average particle size of aggregates of the hard segment is from 4 μm to 20 μm.

15. The process cartridge according to claim 14, wherein particle size distribution (standard deviation σ) of the aggregates of the hard segment is equal to or more than 2 μm.

16. An image forming apparatus comprising:

an image holding member;

a charging device that charges the image holding member;

an electrostatic latent image forming device that forms an electrostatic latent image on a surface of a charged image holding member;

a developing device that develops the electrostatic latent image formed on the surface of the image holding member with toner to form a toner image;

a transfer device that transfers the toner image formed on the image holding member to a recording medium; and the cleaning device according to claim 6 that brings the cleaning blade into contact with the surface of the image holding member for cleaning after the transfer of the toner image by the transfer device.

17. The image forming apparatus according to claim 16, wherein the polyurethane rubber contains a hard segment and a soft segment.

18. The image forming apparatus according to claim 17, wherein a ratio of the hard segment to the soft segment "1" in the polyurethane rubber is 1:0.15 to 1:0.3.

19. The image forming apparatus according to claim 17, wherein an average particle size of aggregates of the hard segment is from 4 μm to 20 μm.

20. The image forming apparatus according to claim 19, wherein particle size distribution (standard deviation σ) of the aggregates of the hard segment is equal to or more than 2 μm.

* * * * *